US007975447B1

(12) United States Patent
Vanden Bosch et al.

(10) Patent No.: US 7,975,447 B1
(45) Date of Patent: Jul. 12, 2011

(54) DECORATIVE TRIM ASSEMBLY

(75) Inventors: Kalvin K. Vanden Bosch, West Olive, MI (US); Brian R. Dykstra, Zeeland, MI (US)

(73) Assignee: P-tec Products, Inc., Zeeland, MI (US)

( * ) Notice: Subject to any disclaimer, the term of this patent is extended or adjusted under 35 U.S.C. 154(b) by 178 days.

(21) Appl. No.: 12/270,352

(22) Filed: Nov. 13, 2008

Related U.S. Application Data

(60) Provisional application No. 60/987,900, filed on Nov. 14, 2007.

(51) Int. Cl.
*E04F 13/00* (2006.01)

(52) U.S. Cl. ..... 52/311.2; 52/311.1; 52/311.3

(58) Field of Classification Search ..... 52/311.1–312
See application file for complete search history.

(56) References Cited

U.S. PATENT DOCUMENTS 3,755,978 A * 9/1973 Jackson ..... 52/127.7
4,223,493 A * 9/1980 Moench et al. ..... 52/200
5,555,688 A * 9/1996 Logan ..... 52/288.1
6,161,351 A * 12/2000 Simpson ..... 52/311.2
7,784,240 B2 * 8/2010 Miller ..... 52/710

* cited by examiner

*Primary Examiner* — Jeanette E Chapman
*Assistant Examiner* — Daniel Kenny
(74) *Attorney, Agent, or Firm* — Van Dyke, Gardner, Linn & Burkhart, LLP

(57) ABSTRACT

A decorative trim assembly is provided for decorating a building exterior. The assembly includes a plurality of trim modules that may be assembled together to form various trim subassemblies. Each trim module includes a decorative portion and at least one rail portion coupled to the decorative portion. The rail portions have end portions and define channels having heights and widths that permit other rail portions to be inserted and retained therein. Some of the rail portions may be cut to facilitate joining with other rail portions, and screw blocks, angle adapters, and end caps are provided to further facilitate the assembly of various trim modules to one another and to the building's exterior. Additionally, customizable trim modules permit the insertion and removal of various emblems, characters, symbols, or the like from the trim modules.

11 Claims, 10 Drawing Sheets

DECORATIVE TRIM ASSEMBLY

CROSS REFERENCE TO RELATED APPLICATION

The present invention claims the benefit of U.S. provisional application Ser. No. 60/987,900, filed Nov. 14, 2007, which is hereby incorporated herein by reference in its entirety.

FIELD OF THE INVENTION

The present invention relates generally to decorative trim, and, more particularly, to decorative trim for a house or similar building.

BACKGROUND OF THE INVENTION

Decorative trim, trimwork, or scrollwork is typically cut from wood and used to decorate the exterior of dwelling structures such as houses. Because of wide variations in home exteriors, such as roof pitch, porch construction, roof fascia, soffit design, and the like, wooden trimwork is often customized by skilled workers off-site after measurements are taken, and then is brought to the site for final installation and customization. This creates added expense and delays in construction, amongst other problems.

SUMMARY OF THE INVENTION

The present invention provides a decorative trim system made up of readily customizable standard pieces that are easily joined to one another and adapted to fit most any structure without requiring skilled woodworkers to perform the installation or assembly.

In one form, the present invention provides a decorative trim assembly including first and second trim modules. Each of the trim modules has a decorative portion and a rail portion coupled to the decorative portion. The rail portion has an end portion and defines a channel. The channel has a first height and a first width, and the end portion has a second height and a second width not greater than the first height and the first width of the channel. The channel of the first trim module receives the end portion of the second trim module for assembling the first and second trim modules together.

In one aspect, the first trim module is substantially identical to the second trim module. Optionally, a third trim module is mountable at one of the first and second trim modules. The third trim module has a decorative portion and a rail portion coupled to the decorative portion. The rail portion has a third height and a third width not greater than the first height and the first width of the channel. The rail portion of the third trim module is adapted to be received into the channel.

In another aspect, the decorative trim assembly includes a screw block at the channel. The screw block receives a screw when the third trim module is fastened to either the first or second trim module with the screw.

In yet another aspect, the decorative trim assembly includes a rail finish cap, a corner bracket, a pendant, a gable post, a gable end, or an angle adapter, any of which may be coupled to either the first or second trim module.

According to another form of the present invention, a decorative trim assembly is provided for a building exterior and includes an emblem member and a trim module for receiving the emblem member. The emblem member has an outer perimeter. The trim module has an aperture for receiving the outer perimeter of the emblem member, which is removable therefrom. The trim module has at least one wall defining the aperture that receives the emblem member. The wall that defines the aperture has first and second pluralities of snap-fit ramped surfaces. The first plurality of snap-fit ramped surfaces are spaced longitudinally from one another and arranged in a first plane. The second plurality of snap-fit ramped surfaces are also spaced longitudinally from one another and are arranged in a second plane that is parallel to the first plane. The first plurality of snap-fit ramped surfaces are arranged in an alternating manner with the second plurality of snap-fit ramped surfaces so that the perimeter member can be snap-fit at the aperture and releasably retained thereat by the first and second pluralities of snap-fit ramped surfaces.

In one aspect, the trim module is a corner bracket module or a pendant module. Both the outer perimeter and the aperture may be circular. The decorative trim assembly may be made of polyvinylchloride, and may include a stabilizer that resists ultraviolet radiation.

In another form of the present invention, a method is provided for installing a decorative trim assembly. The method includes providing a first trim module and a second trim module for attachment to a building exterior. A rail portion is provided at each of the first trim module and the second trim module. The first trim module is attached to the building exterior. A screw block is inserted into the rail portion of the first trim module. The second trim module is attached to the first trim module by inserting the rail portion of the second trim module into the rail portion of the first trim module and driving a fastener through one of the rail portions and into the screw block.

According to yet another form of the present invention, a decorative trim assembly is provided for a building exterior gable. The assembly includes a gable post, a gable end, and at least one gable module. The gable post has a top end, a bottom end, a front flange, and a rear flange. The gable end receives the bottom end of the gable post. The gable module has a decorative portion and a rail portion, and engages both the gable post and the building exterior gable. The front flange and the rear flange of the gable post receive therebetween the decorative portion of the gable module, and the rail portion abuts the building exterior gable.

According to one aspect, the decorative portion of the gable module is fastened to the gable post with a first fastener, and the gable end is fastened to the gable post with a second fastener.

According to another aspect, a rail finish cap is provided to receive an end of the rail portion of the gable module and to span between the rail portion and the top end of the gable post.

Therefore, the decorative trim assembly of the present invention provides a set of decorative modules that are easily customized for a given application at a work site. The assembly is readily assembled with conventional tools and once installed, requires little or no maintenance. The assembly resists discoloration, swelling or shrinking, rot, mildew, cracking, and the formation of gaps. Further, the assembly may include customizable modules that can receive a variety of decorative inserts by snap-fitting emblems or other inserts into or out of the customizable modules.

These and other objects, advantages, purposes, and features of the present invention will become apparent upon review of the following specification in conjunction with the drawings.

DESCRIPTION OF THE PREFERRED EMBODIMENTS

Figure 1A:
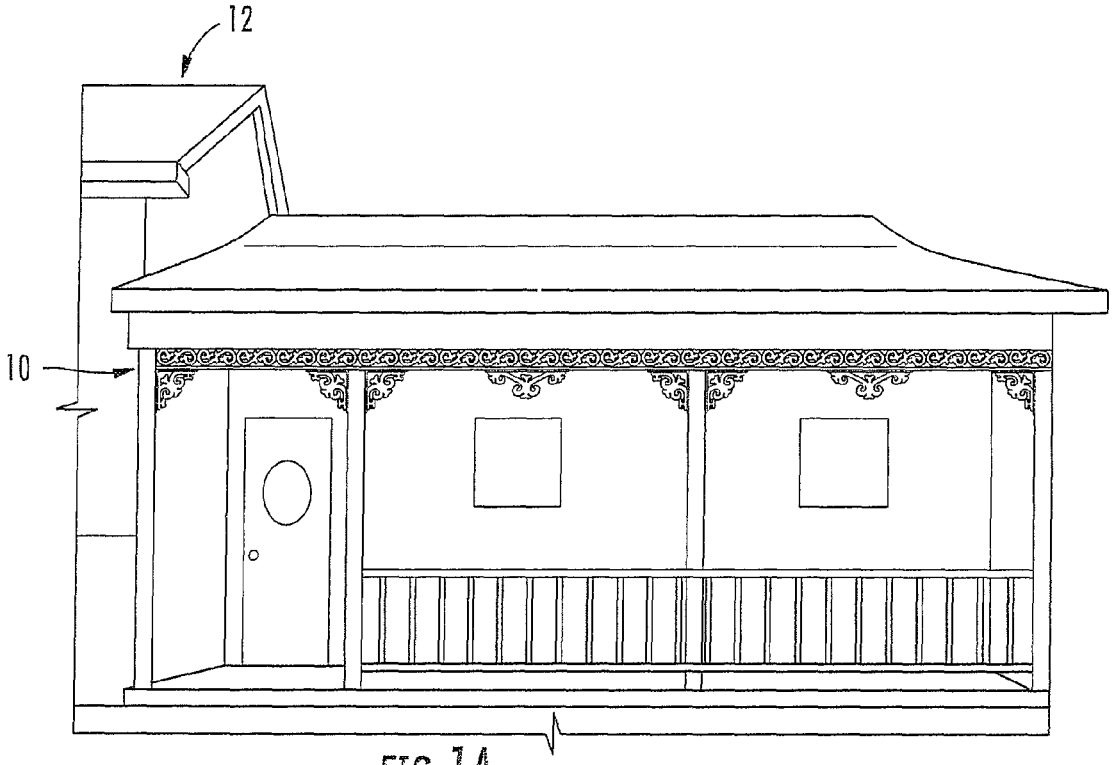
FIG. 1A is a front elevation of a house having a decorative trim assembly in accordance with the present invention.
Figure 1B:
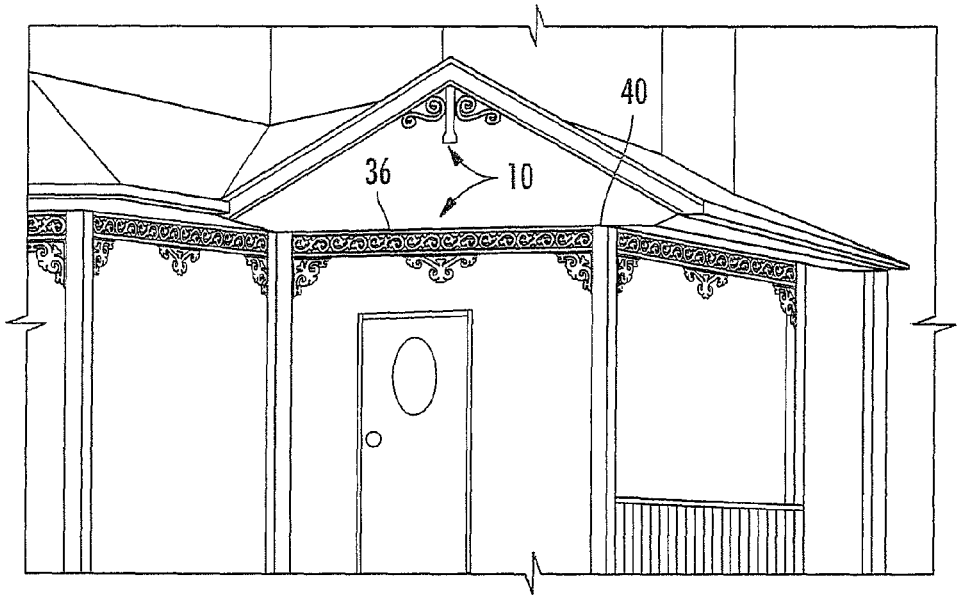
FIG. 1B is another front elevation of another house with a decorative trim assembly of the present invention.
Figure 2:
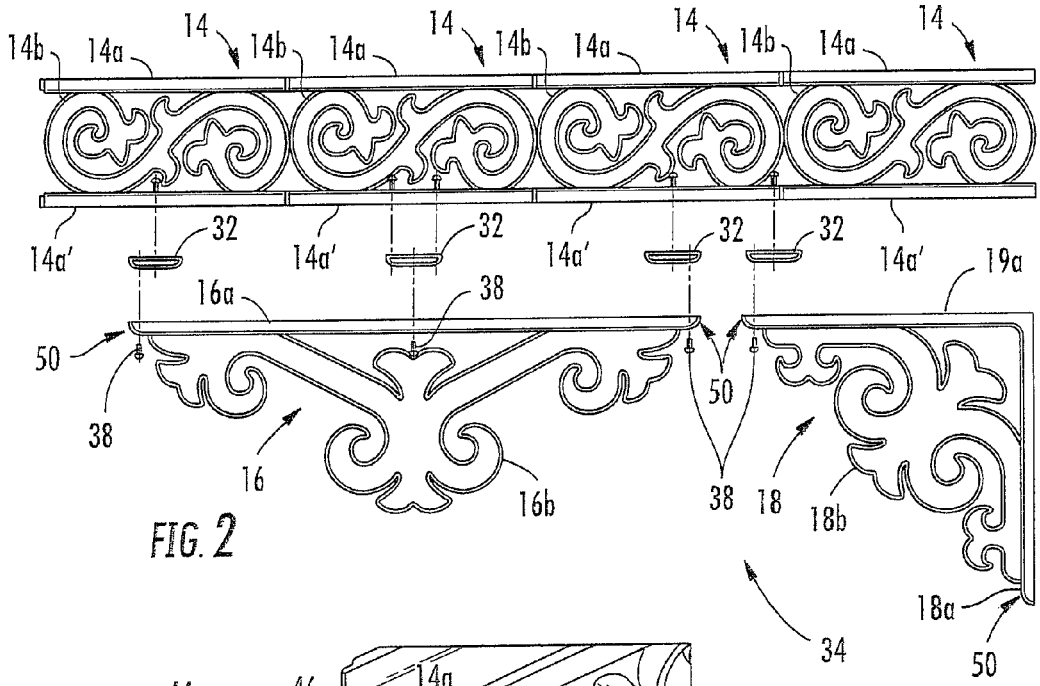
FIG. 2 is an exploded front view of portions of the decorative trim assembly of the present invention.
Figure 6A:
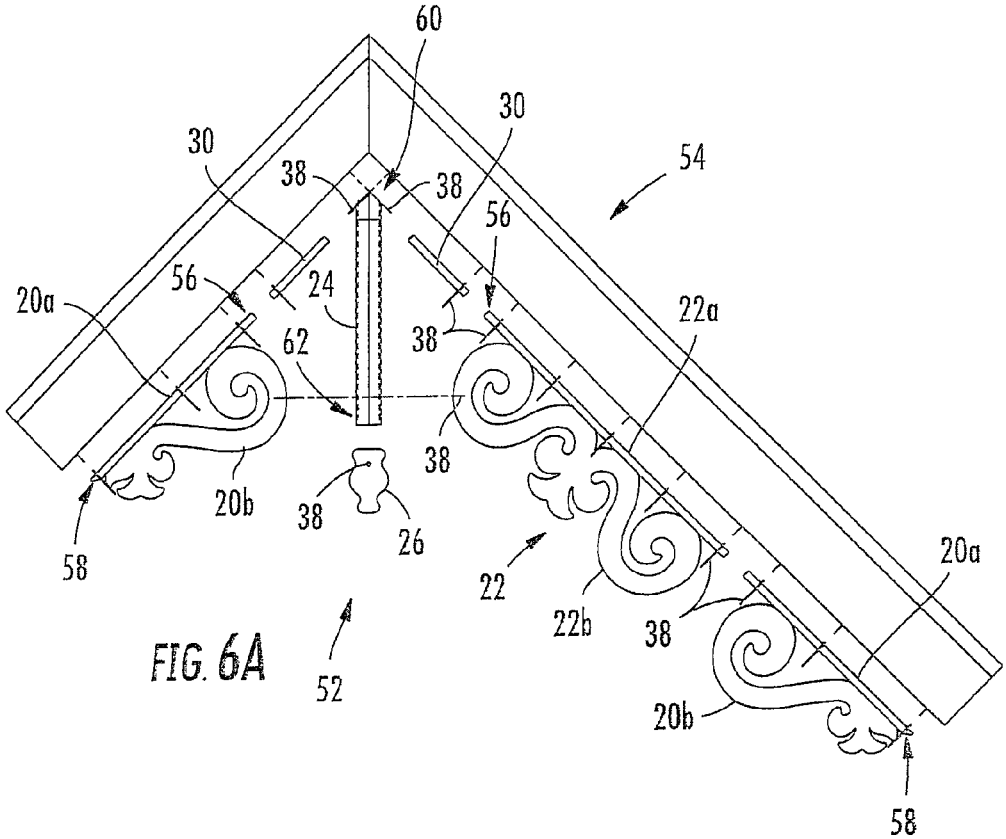
FIG. 6A is an exploded front elevation of a gable portion of the decorative trim assembly.

Referring now to the drawings and the illustrative embodiments depicted therein, a decorative trim assembly 10 is provided for beautifying or decorating the exterior of a building such as a house 12 (FIGS. 1A and 1B). Assembly 10 includes various elements or modules that may be joined together and/or joined to the exterior portions of house 12 to decorate the house as desired by a user. The various modules include, for example, spandrel modules 14, pendant modules 16, corner bracket modules 18, gable modules 20, gable extension modules 22, gable post modules 24, and gable end modules 26 (FIGS. 2 and 6A). Also included for joining and finishing purposes are bracket angle adapter 28, rail finish caps 30, and screw blocks 32. Each module 14, 16, 18, 20, 22, 24, and 26 includes at least one rail portion generally referred to by the suffix a or a' (e.g. spandrel rail 14*a* or 14*a*'), and a decorative portion generally referred to by the suffix b (e.g. spandrel decorative portion 14*b*).

As best seen in FIG. 2, a plurality of modules, such as spandrels 14, pendant 16, and corner bracket 18, may be joined together to form a trim subassembly 34. To build trim subassembly 34, one or more spandrels 14 may be placed or assembled end-to-end and fastened to the underside of a header 36 (FIGS. 1B and 9), as will be described in greater detail below. Pendant 16 and corner bracket 18 are attached to rails 14*a*' on the lower edge of spandrels 14 using fasteners 38 and screw blocks 32. Corner bracket 18 is attachable to rail 14*a* and to post 40 (FIGS. 1B, 9, and 10) and is typically placed at one end of spandrel 14.

Figure 3A:
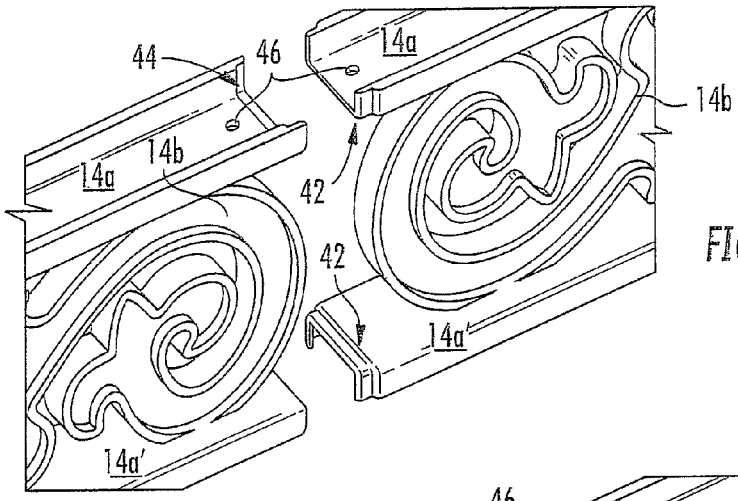
FIG. 3A is a perspective view of a pair of spandrels prior to assembly.
Figure 3B:
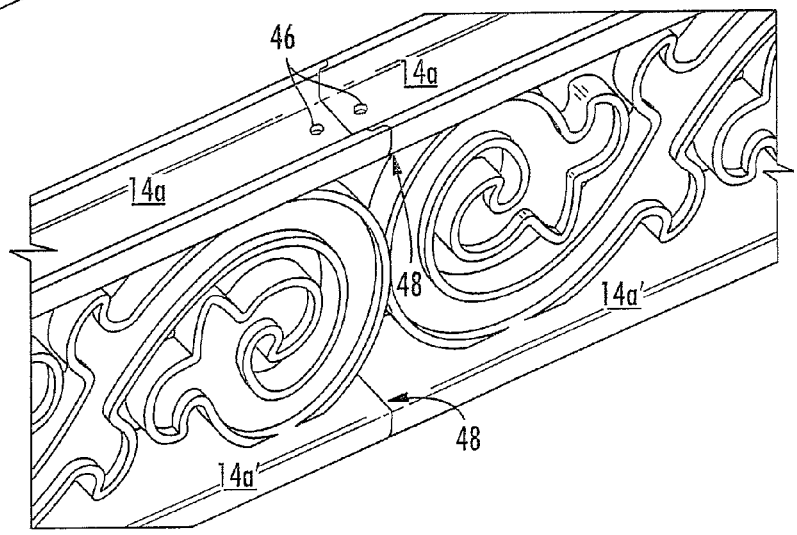
FIG. 3B is a perspective view of the pair of spandrels of FIG. 3A assembled together.

Spandrel rails 14*a*, 14*a*' have a narrowed or reduced-size step or shoulder region 42 at one end, and a corresponding carve-out or recessed region 44 at an end of spandrel rail 14*a*, 14*a*' opposite shoulder region 42 (FIG. 3A). Regions 42, 44 correspond in shape and size to one another so that they may be nested together with the outer surfaces of rails 14*a*, 14*a*' substantially flush and continuous when joined in this manner. Thus, rails 14*a*, 14*a*', shoulder region 42, and recessed region 44 are generally U-shaped and configured such that narrowed regions 42 of one spandrel module are cooperatively received at recessed regions 44 of an adjacent spandrel module (FIG. 3B).

Fastener holes 46 in rails 14*a* (FIGS. 3A, 3B, 8A, and 8B) facilitate the connection of spandrels 14 to header 36 with fasteners 38 that are driven through holes 46. Thus, as many spandrels as are desired may be assembled end-to-end with regions 42, 44 on rails 14*a*, 14*a*' nested together to form a continuous spandrel assembly. Expansion spaces or joints 48 (FIG. 3B) may be left where narrowed regions 42 are received in recessed regions 44 to permit the expansion and contraction of spandrels 14 in various weather and temperature conditions. Expansion joint 48 is a slider joint that exposes a greater or lesser amount of shoulder region 42 when spandrel modules 14 contract and expand, such as in cold and hot weather, respectively. Preferably, when assembly 10 is installed in hot weather, a relatively small amount of shoulder region 42 is left exposed to permit contraction in cold temperatures, and when assembly 10 is installed in cold weather, a relatively large amount of shoulder region 42 is left exposed to permit expansion in warm temperatures.

Figure 4:
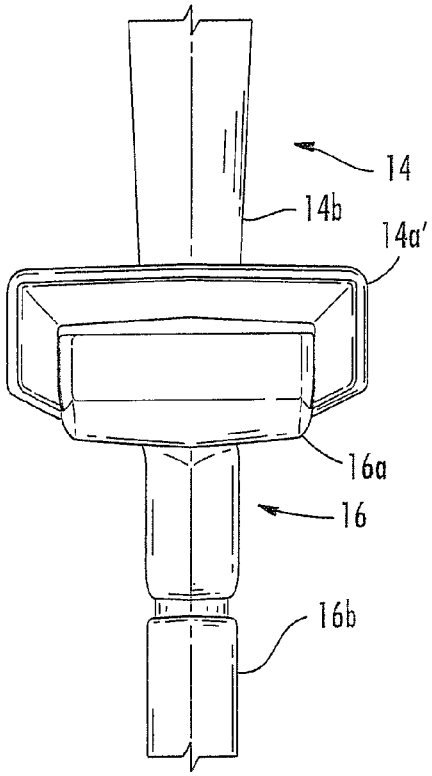
FIG. 4 is an end elevation of a spandrel and a pendant assembled together.
Figure 5A:
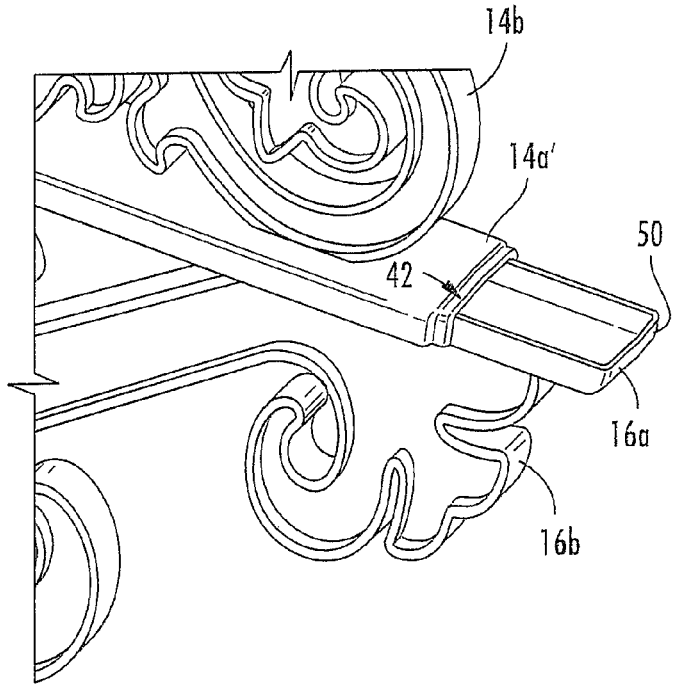
FIG. 5A is a perspective view of the spandrel and pendant of FIG. 4.
Figure 5B:
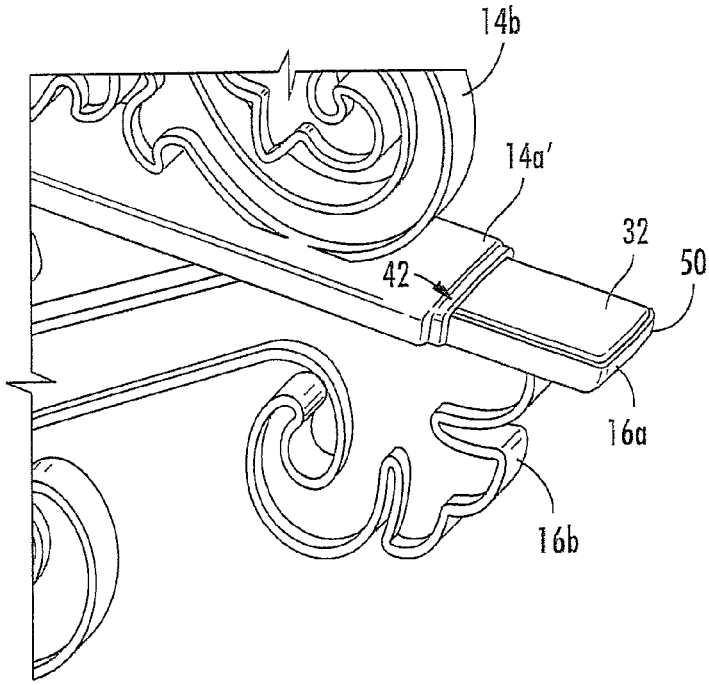
FIG. 5B is a perspective view of the spandrel and pendant of FIG. 5A having a screwblock in rail portions of the spandrel and pendant.

Pendant 16 and corner bracket 18 may be used independently or in combination with spandrels 14. Pendant rail 16*a* and corner bracket rail 18*a* are sized to be received within rails 14*a*' of spandrels 14 (FIGS. 2 and 4-5B). As best seen in FIG. 4, rails 16*a*, 18*a* have a width that is approximately equal to or less than the inner width of rails 14*a*' of spandrel 14 so that rails 16*a*, 18*a* may be inserted within or slid into rails 14*a*'. Rails 14*a*' form generally U-shaped channels for receiving rails 16*a*, 18*a*. Rails 16*a*, 18*a* form generally U-shaped channels for receiving screw blocks 32. Rails 16*a*, 18*a* are formed with finished ends 50 that close off the ends of rails 16*a*, 18*a* to hide the channels and present a finished look. In order to improve the fastenability of pendant 16 and corner bracket 18 to spandrels 14, screw blocks 32 may be inserted into the U-shaped channels of rails 16*a*, 18*a* so that fasteners 38 (which may be threaded screws or the like) may be driven into screw blocks 32 from rails 16*a*, 18*a*, and also from rails 14*a*', without the pointed tips of fasteners 38 protruding from any of the rails (FIGS. 2, 5A, and 5B).

Figure 6B:
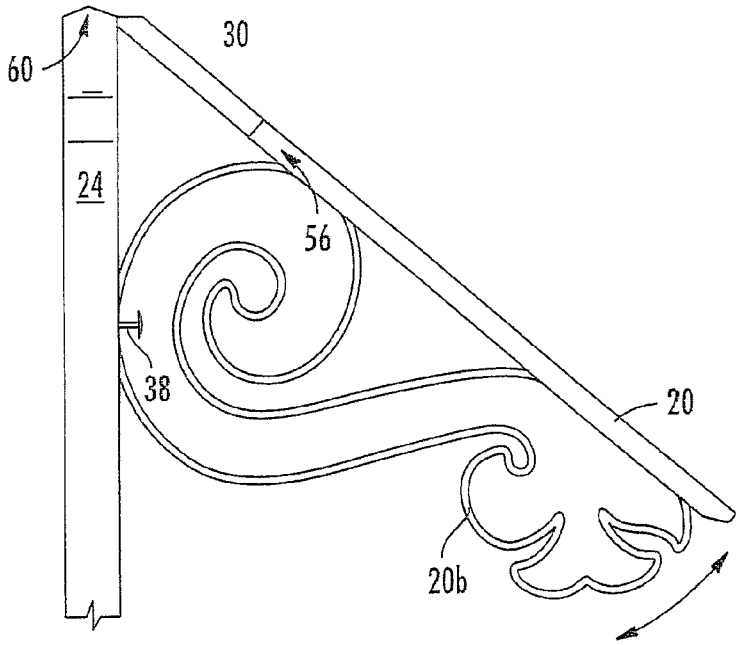
FIG. 6B is an enlarged front elevation of an upper portion of a gable portion of the decorative trim assembly.

A gable subassembly 52 may be assembled at a gable 54 (FIG. 6A) in a similar manner as trim subassembly 34 is installed at header 36 and post 40. Gable subassembly 52 includes at least one gable module 20, gable post module 24, and gable end module 26. Gable subassembly 52 may also include one or more gable extension modules 22 for extending gable subassembly 52 along gable 54. Gable extension rail 22*a* and gable rail 20*a* are substantially similar and include elongated narrow regions 56 at one end and finished ends 58 opposite elongated narrow regions 56. It will be appreciated that finished ends 58 may be substantially identical to finished ends 50 of pendant 16 and corner bracket 18. Elongated narrow regions 56 of rails 20*a*, 22*a* are elongated narrowed portions of rails 20*a*, 22*a* and have closed ends. As best seen in FIG. 6B, rail finish caps 30 have substantially the same size and shape as rails 16*a*, 18*a*, 20*a*, and 22*a*, and are complimentarily sized to receive elongated narrow regions 56 of rails 20*a*, 22*a* in a nesting manner, similar to the manner in which shoulder regions 42 are received in recessed regions 44 of spandrel rails 14, described above.

Figure 8A:
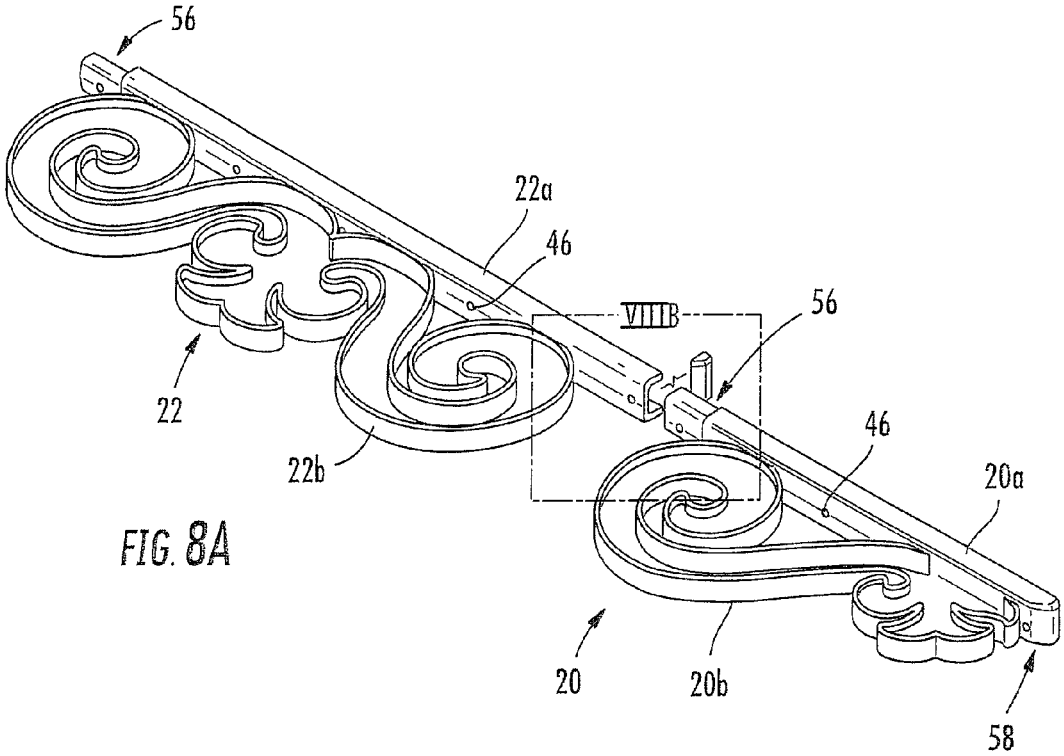
FIG. 8A is a perspective view of a gable module and a gable extension module.
Figure 8B:
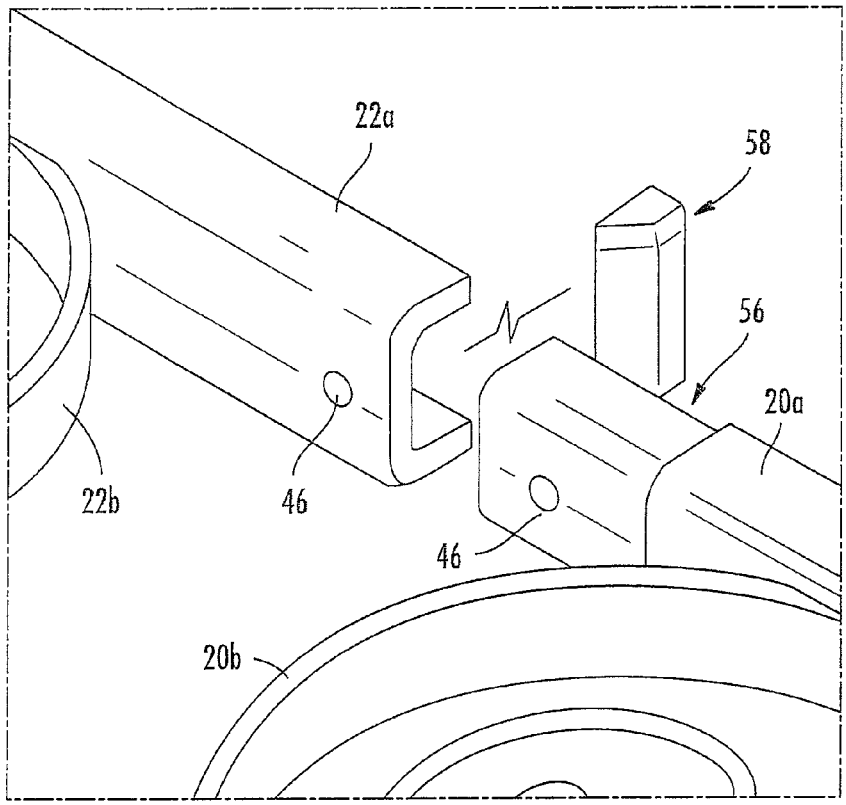
FIG. 8B is an enlarged perspective view of the section labeled VIIIB in FIG. 8A.

As best seen in FIG. 8B, elongated narrowed region 56 may be assembled at rail 22*a* or 20*a*, by first cutting off or removing finished end 58 from the rail of the adjacent module and inserting narrowed region 56 into rail 22*a* or 20*a*. The modules are attached to gable 54 via fasteners 38 inserted through fastener holes 46. Gable post 24 is cut at a top end 60 to match the apex angle of gable 54 (FIGS. 6A and 6B), and may be cut at a lower end 62 to a desired overall length. One or more fasteners 38 may be driven through top end 60 of gable post 24 and into gable 54. Preferably, at least two fasteners 38 are driven from one side of gable post 24 and at least one fastener 38 is driven from the other side to stabilize post 24 in proper alignment (FIG. 6A).

Rail finish cap 30 has substantially the same dimensions of gable extension rail 22*a* and gable rail 20*a*, and may be cut and/or trimmed to fill any gap between top end 60 of gable post 24 and gable extension module 22 or gable module 20 (FIG. 6B). Rail finish cap 30 is configured to cover at least a portion of elongated narrow region 56 of rail 22*a* or 20*a*. Decorative portion 20*b*, 22*b* of gable module 20 and gable extension module 22 may be fastened to gable post module 24 with fasteners 38 to stabilize and support gable subassembly 52. Further, a portion of decorative portions 20*b*, 22*b* may be received in a channel 65 of gable post 24, as will be described in greater detail below.

Gable end module 26 is attachable at lower end 62 of gable post module 24 in order to present a finished look for gable subassembly 52. Gable post 24 is configured as an I-beam with an additional intermediate flange 63*a* between front and rear flanges 63*b*, 63*c* (FIG. 7C). Intermediate flange 63*a* may be narrower in width than front flange 63*b* and rear flange 63*c* to form channel 65 so that a portion of decorative portions 20*b*, 22*b* may be inserted into channel 65 such that decorative portions 20*b*, 22*b* abut intermediate flange 63*a* and frictionally engage inner facing surfaces of front flange 63*b* and rear flange 63*c*. This arrangement permits gable module 20 and/or gable extension module 22 to be angularly adjusted relative to gable post 24, as indicated by a double arrow in FIG. 6B, to match any roof pitch angle at gable 54. Thus, decorative portion 20*b*, 22*b* engages channel 65 with a portion of the decorative portion's curved periphery, which portion is somewhat or slightly different as the angle of modules 20, 22 changes for gables of different pitches. Decorative portion 20*b*, 22*b* is fastened with fastener 38, which is driven through the curved portion that engages post 24, and into post 24 for a clean, custom appearance regardless of the roof pitch at gable 54.

Figure 7A:
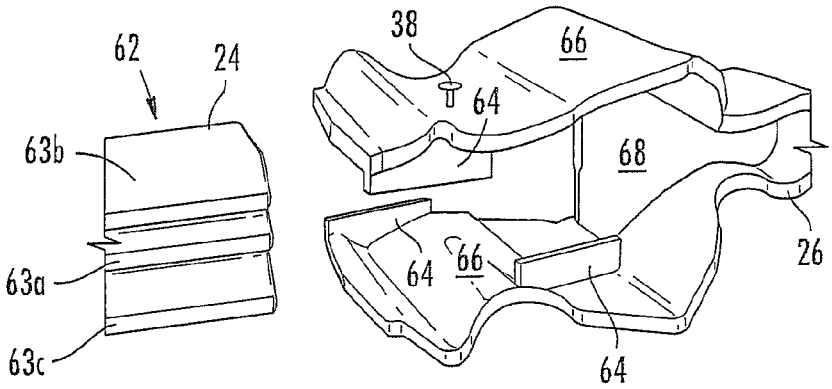
FIG. 7A is a perspective view of a gable post and gable end prior to assembly.
Figure 7B:
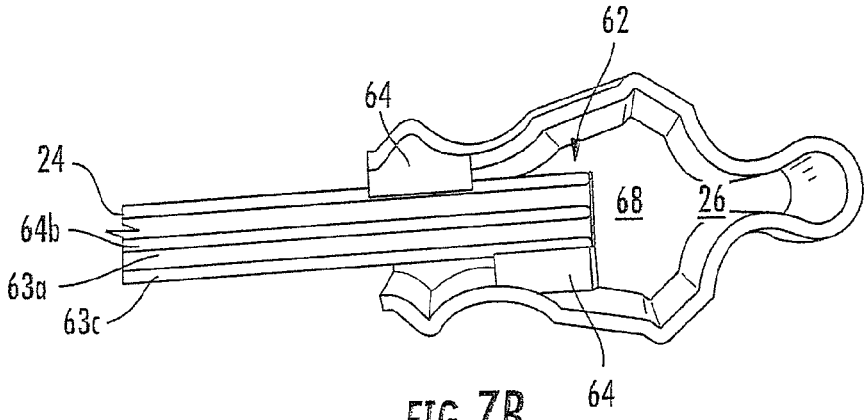
FIG. 7B is a side elevation of the gable post and gable end assembled together.
Figure 7C:
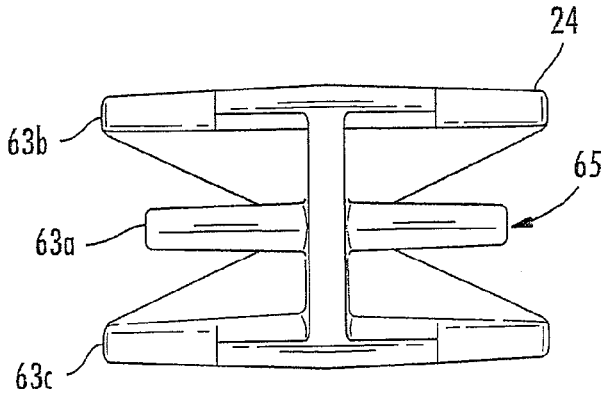
FIG. 7C is an end elevation of a gable post.

As best seen in FIGS. 7A and 7B, bottom end 62 of gable post 24 is received in gable end module 26 by a plurality of spaced flanges or tabs 64 that project inwardly from inner surfaces of a pair of front/back panels 66, which are joined by a web 68. A fastener 38 (FIG. 6A) may be driven through either of front/back panels 66 and into any of flanges 63*a*, 63*b*, 63*c* to hold gable post module 24 to bottom end 62 of gable post 24.

Figure 14:
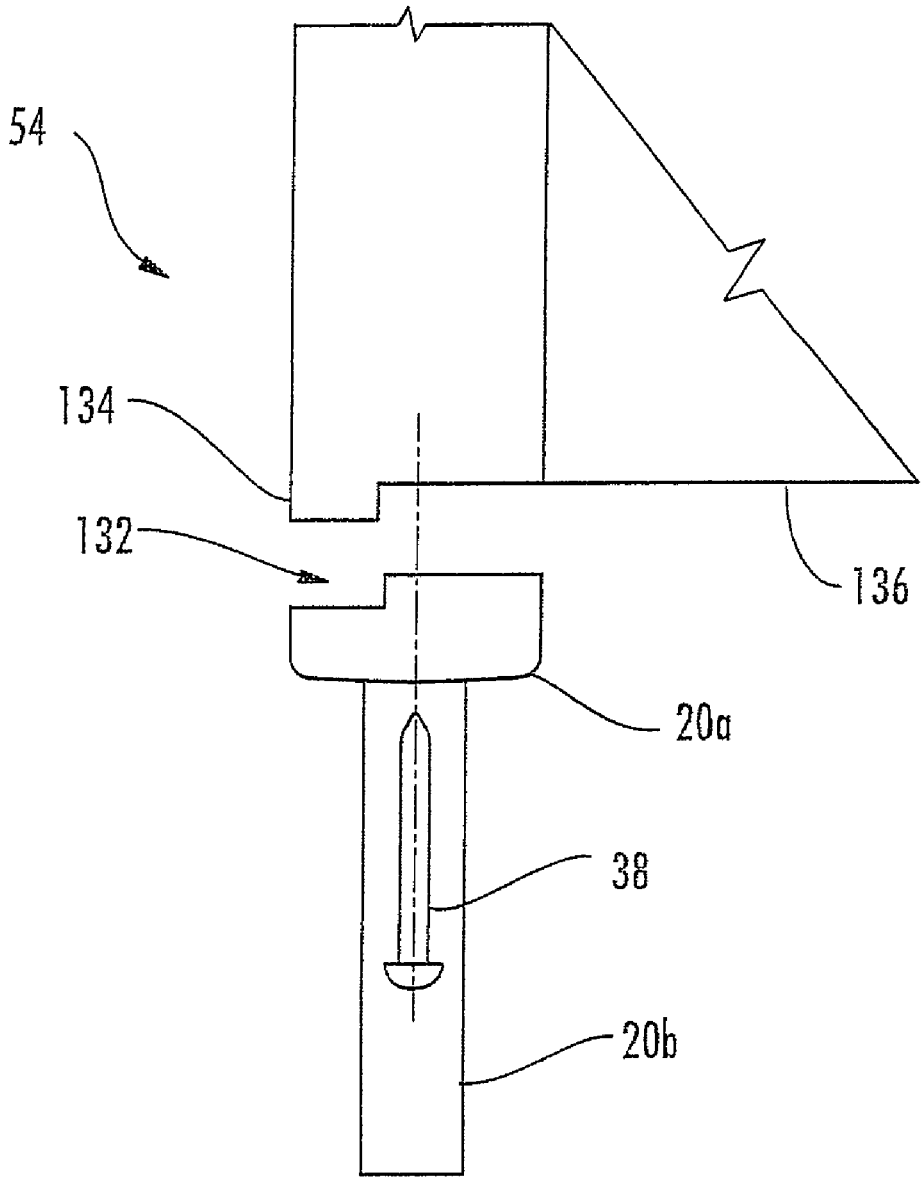
FIG. 14 is a side sectional view of a portion of a gable module prior to attachment at a roof overhang.

Gable subassembly 52 may be further customized for house 12, such as by trimming gable module rail 20*a* to form a notch 132 along its entire length (FIG. 14). Notch 132 permits rail 20*a* to receive a fascia projection 134 that extends below a bottom surface of a soffit 136 forming a roof overhang at gable 54. It will be appreciated that the various modules of assembly 10 may be trimmed or custom-fit at the work site, in the described manner or in a similar manner, to fit the needs of the particular application.

Decorative trim assembly 10 may be made of any moldable material that is preferably strong, readily cut with saws or other tools, possesses a low coefficient of thermal expansion, is colorfast, and is resistant to weather and embrittlement. Preferably, assembly 10 is made of a material that is somewhat compliant or resilient to facilitate assembly and to permit fastening the assembly without cracking or deforming. For example, assembly 10 may be made of polyvinyl chloride (PVC) with ultraviolet (UV) stabilizers, and may be tinted or colored as desired.

Figure 9:
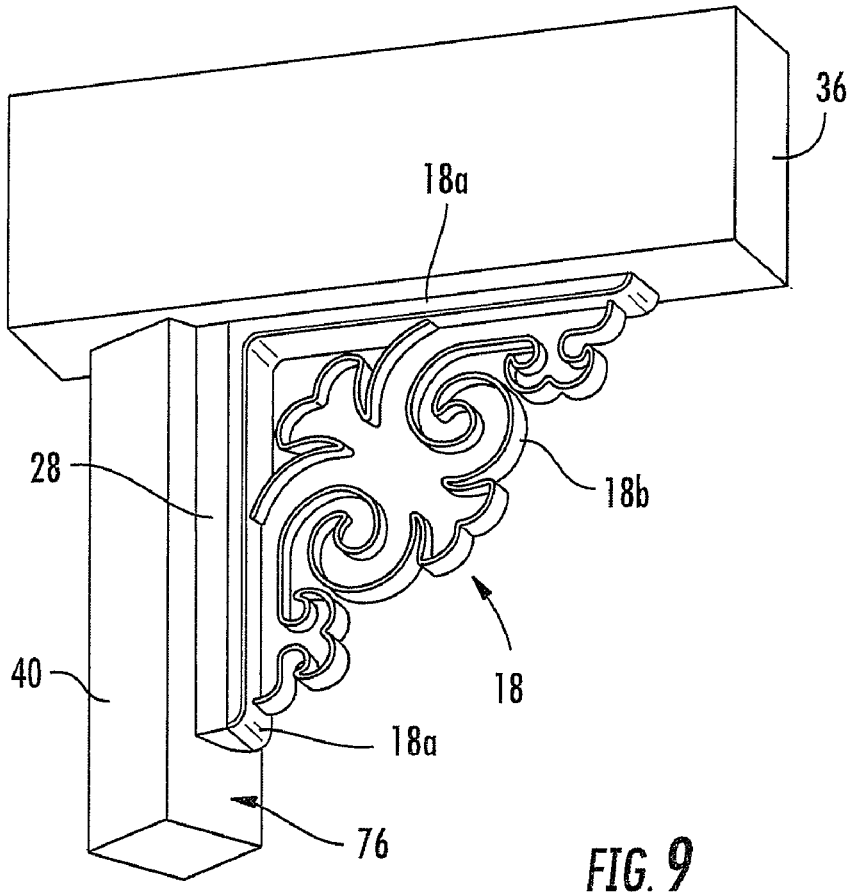
FIG. 9 is a perspective view of a corner bracket and angle adapter installed at a vertical post and header.
Figure 10:
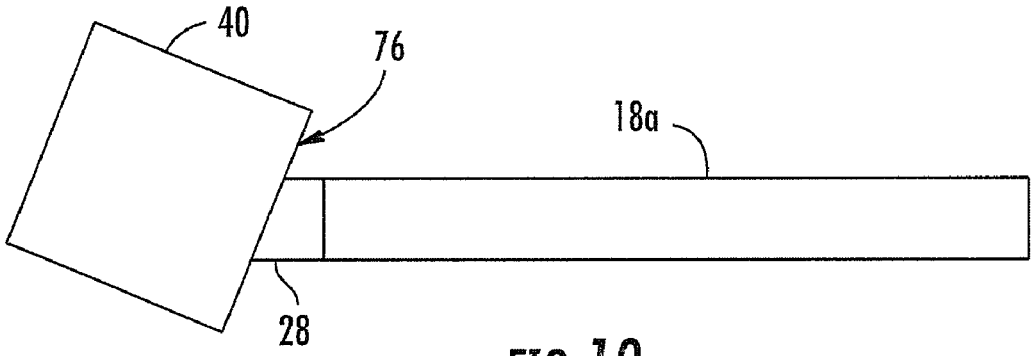
FIG. 10 is a top plan of the corner bracket, adapter, and vertical post of FIG. 9.
Figure 11A:
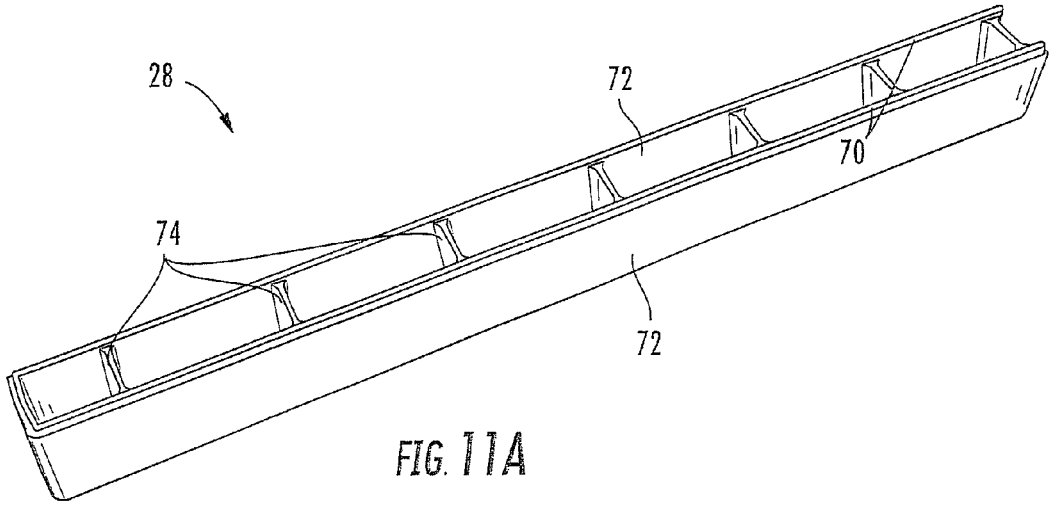
FIG. 11A is a perspective view of a bracket angle adapter as shown in FIGS. 9 and 10, taken from the front and side thereof.
Figure 11B:
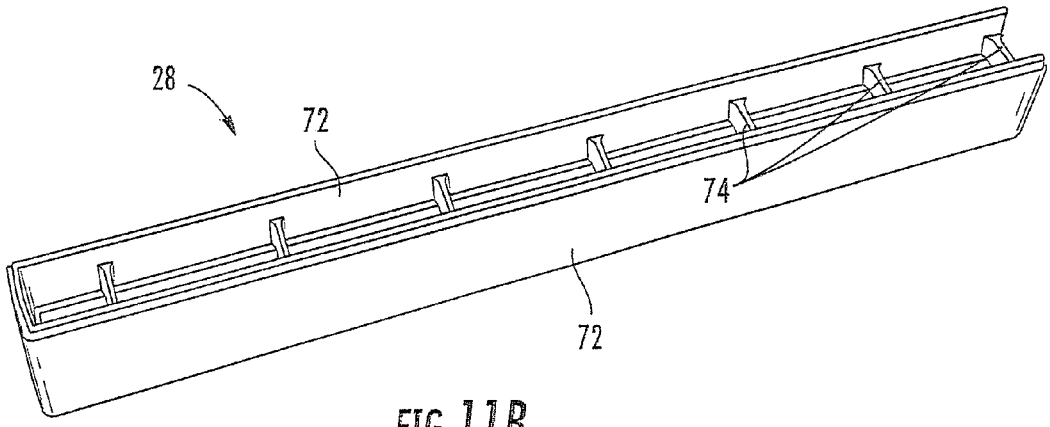
FIG. 11B is a perspective view of the bracket angle adapter of FIG. 11A, taken from the back and opposite side thereof.
Figure 12:
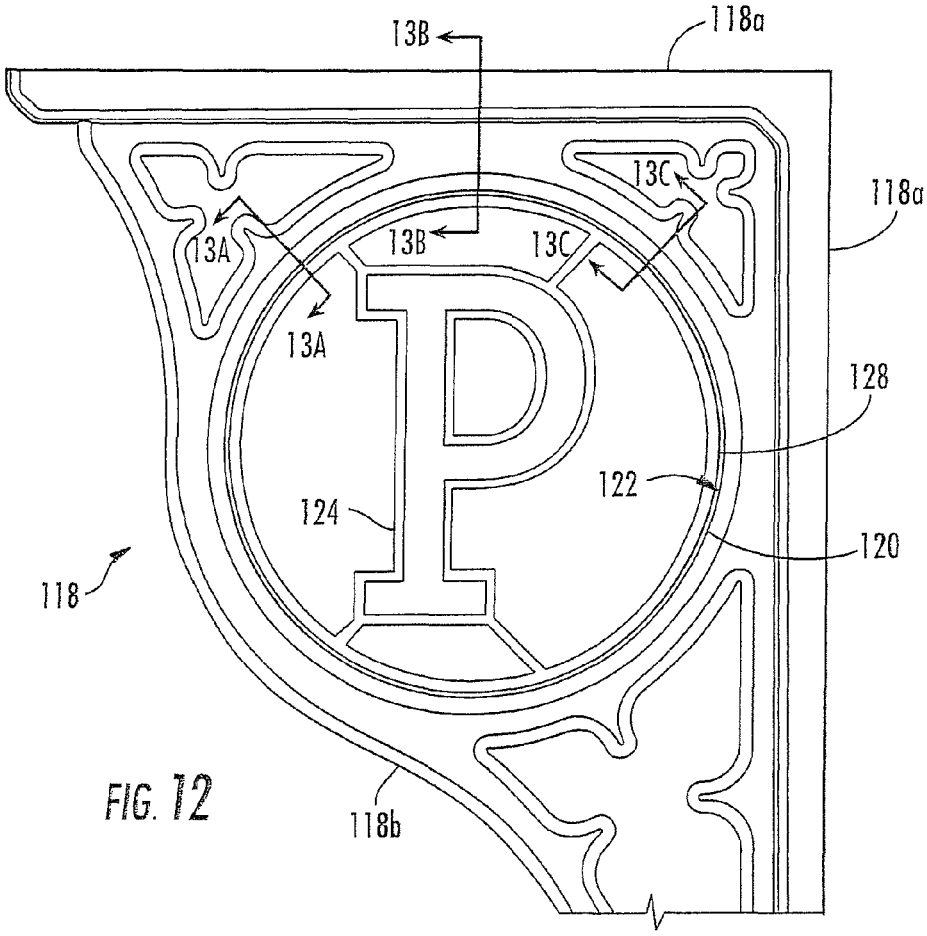
FIG. 12 is a front elevation of another corner bracket including a selected emblem assembled therewith in accordance with the present invention.

Referring now to FIGS. 9-11B, bracket angle adapter 28 has a bracket-facing side with a flange 70 for receiving rail 18*a* of corner bracket module 18. Adapter 28 includes a pair of side panels 72 connected via a plurality of webs 74. As best seen in FIGS. 9 and 10, bracket angle adapter 28 may be angle-cut at its back side, opposite flange 70, so that corner bracket module 18 may be placed against post 40 without a gap when post 40 has a face 76 set at an angle to corner bracket rail 18*a*.

Referring now to FIGS. 12 and 13A-13C, a customizable corner bracket module 118 includes a rail portion 118*a* and a decorative portion 118*b*. Decorative portion 118*b* includes a passageway or aperture 120 bounded by an inner perimeter wall 122. In the preferred embodiment of FIG. 12, aperture 120 is circular in shape, although other shapes, such as polygons, are possible. A decorative insert 124 has a perimeter projection 126 along or around an entire perimeter wall 128 of decorative insert 124. Perimeter wall 128, as shown in FIGS. 12 and 13A-13C, is circular and of complimentary size to aperture 120, although other complimentary shapes are possible and vary with the size and shape of the aperture in the decorative portion of the customizable module.

Figure 13A:
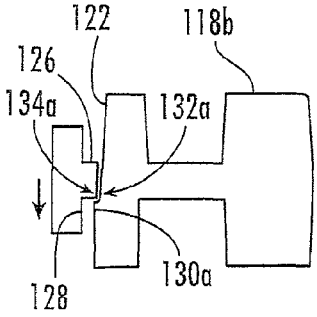
FIGS. 13A-13C are sectional views taken along lines 13A-13C in FIG. 13.
Figure 13B:
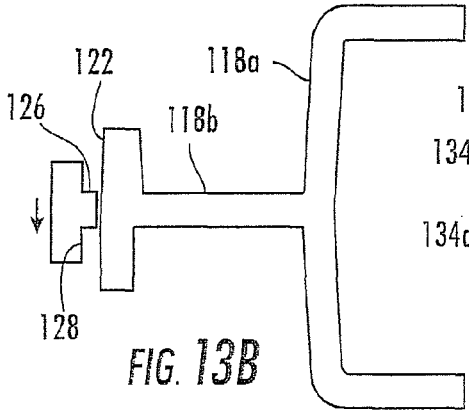
Figure 13C:
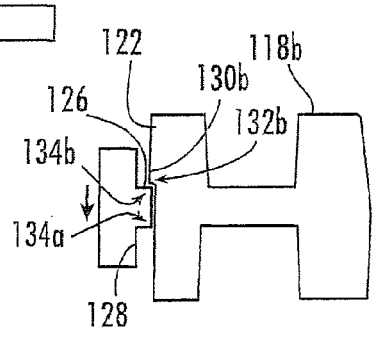

Inner perimeter wall 122 includes a series of alternating ledges or ramped surfaces 130*a*, 130*b*, each ramped surface having a ridge or shoulder 132*a*, 132*b* for engaging a corner 134*a*, 134*b* of perimeter projection 126 of decorative insert 124. Ramped surfaces 130*a* are formed along inner perimeter wall 122 and spaced circumferentially apart from one another with ramped surfaces 130*b* interspersed between ramped surfaces 130*a* so that at any given point along inner perimeter wall 122, only one ramped surface (130*a* or 130*b*), is formed. Shoulders 132*a*, 132*b* are thus oppositely-facing. Optionally, and as shown in FIG. 13B, no shoulder is formed in the circumferential area between ramped surfaces 130*a* and ramped surfaces 130*b*.

Accordingly, decorative insert 124 may be snap-fit to decorative portion 118*b* at inner perimeter wall 122 from either side of customizable corner bracket module 118. For example, and with reference to FIGS. 13A-13C, decorative insert 124 may be inserted into aperture 120 in a direction indicated by downwardly-pointing arrows. When inserted in this direction, corner 134*a* of perimeter projection 126 moves or slides along ramped surfaces 130*b* (FIG. 13C) until corner 134*b* snaps past or over shoulder 132*b*. In the regions of inner perimeter wall 122 having ramped surfaces 130*a*, corner 134*a* moves or slides along inner perimeter wall 122 until corner 134*a* encounters shoulder 132*a* (FIG. 13A), which prevents further movement of decorative insert 124 in the direction of insertion indicated by the arrows.

Thus, when decorative insert 124 is fully inserted into aperture 120, shoulders 132*a* of ramped surfaces 130*a* prevent further movement of insert 124 in the direction of insertion, and shoulders 132*b* of ramped surfaces 130*b* prevent the removal of insert 124 in a direction opposite to the direction of insertion. Decorative insert 124 is thus held centered in place by oppositely facing shoulders 132*a*, 132*b*. It will be appreciated that decorative insert 124 may be inserted into aperture 120 from either side of customizable corner bracket module 118 until corners 134*a*, 134*b* engage shoulders 132*a*, 132*b*, respectively. Because decorative insert 124 and corner bracket module 118 are made of somewhat resilient materials, the application of a force somewhat greater than the force required for insertion of decorative insert 124 into aperture 120 may be applied to urge corners 134*a* or 134*b* over and past shoulders 132*a* or 132*b* for removal or replacement of decorative insert 124.

It will be appreciated that an even number of ramped surfaces 130*a*, 130*b* are desirable to evenly distribute insertion and removal forces of decorative insert 124 into aperture 120. At least four ramped surfaces 130*a*, 130*b* are preferred for preventing decorative insert 124 from twisting or rotating out of aperture 120. However, it is envisioned that a greater or fewer number of ramped surfaces may be used to hold the decorative insert in the aperture of the decorative portion of the corner bracket module without departing from the spirit and scope of the present invention. The decorative insert may include any number of letters, numerals, insignia, patterns, or decorations, and it will further be appreciated that such inserts may be applied to other types of trim modules, such as pendants, gables; spandrels, and the like.

Accordingly, decorative trim assembly 10 provides a low maintenance decorative system for a house or other building that can be custom-fit and assembled at the work site. On-site fitting and assembly of decorative trim assembly 10 thus may be performed with only minor cutting and trimming during the assembly process to fit the various modules together and to attach them to one another and to the building.

Decorative trim assembly 10 is easily customized at the job site with conventional tools, such as hand saws or miter saws, and does not require ongoing maintenance tasks such as scraping and repainting to preserve its appearance. Decorative trim assembly 10 resists rot, mildew, wood-eating organisms, and, further, resists expansion and contraction in the presence of moisture, heat, and humidity alternating with colder temperatures and dryness. Thus, the trim assembly 10 resists forming unsightly gaps between adjacent pieces of trim, loosening of the trim from the building, and cracking or splitting of the trimwork itself.

Changes and modifications in the specifically described embodiments may be carried out without departing from the principles of the present invention, which is intended to be limited only by the scope of the appended claims, as interpreted according to the principles of patent law including the doctrine of equivalents.

The embodiments of the invention in which we claim an exclusive property or privilege are defined as follows:

1. A decorative trim assembly for a building exterior, said assembly comprising:

an emblem member having an outer perimeter;

a trim module having an aperture adapted to removably receive said outer perimeter of said emblem member, said trim module having at least one wall defining said aperture;

a first plurality of snap-fit ramped surfaces at said at least one wall, said first plurality of snap-fit ramped surfaces spaced longitudinally from one another and arranged in a first plane; and a second plurality of snap-fit ramped surfaces at said at least one wall, said second plurality of snap-fit ramped surfaces spaced longitudinally from one another and arranged in a second plane substantially parallel and spaced from said first plane;

wherein said first plurality of snap-fit ramped surfaces are arranged in an alternating manner with said second plurality of snap-fit ramped surfaces, and wherein said perimeter member is snap-fit at said aperture and releasably retained thereat by said first and second pluralities of snap-fit ramped surfaces.

2. The decorative trim assembly according to claim 1, wherein said trim module comprises a corner bracket.

3. The decorative trim assembly according to claim 1, wherein said trim module comprises a pendant.

4. The decorative trim assembly according to claim 1, wherein said outer perimeter and said aperture are circular.

5. The decorative trim assembly according to claim 1, wherein said assembly comprises a polyvinylchloride material.

6. The decorative trim assembly according to claim 5, wherein said polyvinylchloride material comprises a stabilizer resistant to ultraviolet radiation.

7. A decorative trim assembly for a building exterior gable, said assembly comprising:

a gable post, said gable post having a top end, a bottom end, a front flange, and a rear flange;

a gable end, said gable end adapted to receive said bottom end of said gable post; and at least one gable module having a decorative portion and a rail portion, said gable module adapted to engage said gable post and the building exterior gable;

wherein said front flange and said rear flange are cooperatively adapted to receive said decorative portion of said at least one gable module, and said rail portion is adapted to abut the building exterior gable.

8. The decorative trim assembly of claim 7, wherein said decorative portion of said at least one gable module is fastened to said gable post with a first fastener, and wherein said gable end is fastened to said gable post with a second fastener.

9. The decorative trim assembly of claim 7, further comprising a rail finish cap adapted to receive an end of said rail portion of said gable module and to span between said rail portion and said top end of said gable post.

10. The decorative trim assembly according to claim 7, wherein said assembly comprises a polyvinylchloride material.

11. The decorative trim assembly according to claim 10, wherein said polyvinylchloride material comprises a stabilizer resistant to ultraviolet radiation.

* * * * *